US005105931A

United States Patent [19]

Lashyro

[11] Patent Number: 5,105,931

[45] Date of Patent: Apr. 21, 1992

[54] ARTICLE CONTROL ASSEMBLY

[75] Inventor: Jeffrey A. Lashyro, Crosby, Minn.

[73] Assignee: Minnesota Automation, Inc., Crosby, Minn.

[21] Appl. No.: 598,375

[22] Filed: Oct. 16, 1990

[51] Int. Cl.[5] ..... B65G 17/46

[52] U.S. Cl. ..... 198/471.1; 198/476.1; 198/803.5; 198/803.9

[58] Field of Search ..... 414/732, 736, 737; 198/475.1, 474.1, 471.1, 803.5, 803.9; 271/95; 493/315, 318

[56] References Cited

U.S. PATENT DOCUMENTS

| | | | |
|---|---|---|---|
| 2,887,022 | 5/1959 | Lubersky et al. | 493/315 X |
| 3,242,827 | 3/1966 | Winters | 493/315 |
| 3,386,558 | 6/1968 | Benatar | 198/471. 1 X |
| 4,050,574 | 9/1977 | Chenevard et al. | 198/471. 1 X |
| 4,135,619 | 1/1979 | Cerboni | 198/471.1 |
| 4,530,686 | 7/1985 | Everson et al. | 493/315 |
| 4,537,587 | 8/1985 | Langen | 493/315 |
| 4,537,587 | 8/1985 | Langen | 493/315 |
| 4,643,633 | 2/1987 | Lashyro | 414/732 |
| 4,735,600 | 4/1988 | Drewke et al. | 493/315 X |
| 4,881,934 | 11/1989 | Everson | 53/398 |
| 4,881,934 | 11/1908 | Harston et al. | 493/315 |
| 4,901,843 | 2/1990 | Lashyro | 198/471.1 X |
| 4,902,192 | 2/1990 | Ziegler | 198/476.1 X |

*Primary Examiner*—D. Glenn Dayoan

*Attorney, Agent, or Firm*—Anthony G. Eggink; Joel D. Skinner

[57] ABSTRACT

An article transfer mechanism of an article transfer device comprising a support structure having a central axis, at least one engagement member extending from the support structure perpendicular to the support structure axis. The engagement member contacts an article at a first predetermined location thereon. The mechanism also includes a synchronized vacuum control system which provides vacuum to the engagement member. At least one article control member is further provided to contact the article at a second predetermined location and apply a force thereto, whereby the synchronized engagement member and article control member permit the article to be transferable at high speed.

27 Claims, 3 Drawing Sheets

ARTICLE CONTROL ASSEMBLY

BACKGROUND OF THE INVENTION

This invention relates to article transfer devices for the pickup, transfer, and delivery of articles. Particularly, this invention relates to an article control assembly for use with an article transfer mechanism of an article transfer device to increase the speed and reliability of transferring articles from and to a plurality of predetermined locations and in a plurality of transfer paths.

It has become increasingly necessary and desirable in mechanized manufacturing, assembly, and packaging operations to enable the pickup, transfer, and delivery of articles of various shapes and dimensions in the most reliable, precise, and high-speed manner. Many types of such devices have been developed, including the utilization of rotary transfer devices having one or more article transfer mechanisms.

However, due to the many configurations, shapes and sizes of articles required to be transferred and processed, it has become increasingly difficult for manufacturers and assemblers to use suitable article transfer mechanisms which enable the precise, reliable and high speed pickup, transfer, and placement of these articles.

The article control assembly and its associated article transfer mechanism of this invention are for use in an article transfer device, such as a rotary transfer device, to increase the efficiency, accuracy and speed of transferring and placing various articles at predetermined locations. Particularly, the article control assembly is useful with a high speed rotary transfer device to transfer carton blanks, to open them, and to set them in a particular position, all at high speed, for subsequent packaging purposes. The article control assembly functions in cooperation with standard vacuum cups of an article transfer mechanism to pickup, hold and place the articles during transfer. The article control assembly of this invention comprises a separate control vacuum cup or cups constructed and arranged to engage articles at a predetermined location and for a predetermined period, in timed synchronization with the standard vacuum cups of the article transfer mechanism. An additional feature of the article control assembly is a stabilizing member which places a predetermined force on a predetermined location on the article, also in synchronization with the vacuum cup members.

Although various means have been taught to transfer articles from one location to another, and although one reliable and desirable means is the utilization of a rotary transfer mechanism, shortcomings and limitations with respect to the effective transfer of articles still exist. These limitations and shortcomings include the inability of the transfer mechanism to reliably pickup, transfer and place articles all at high speed. For example, during high speed pickup, engagement may be incomplete or misplaced, thus, causing a failure in the subsequent transfer and placement processes. Also, during high speed transfer, certain article configurations may have a tendency to loose their structural integrity and either become dislodged or unable to become properly erected. And, during placement, disengagement at high speed may be unsteady causing misaligned placement. These shortcomings and limitations generally relate to the structure of the articles, as well as limitations inherent in the design of the article transfer mechanisms themselves. Particularly, the shortcomings and limitations are due to the inability of the transfer mechanisms to hold and stabilize articles so as to maintain their desired structural configurations at high rates of transfer. This is particularly a problem for articles having tall configurations relative to their width. The article control mechanism of this invention having the control vacuum member and stabilizing member is designed to overcome the limitations of the prior known mechanisms. As far as is known, and despite the need for article control assemblies of this nature, no such devices have been disclosed or proposed.

SUMMARY OF THE INVENTION

The present invention provides a high speed article transfer mechanism for engaging, transporting and disengaging articles, such as carton blanks, and for use with article transfer devices, such as a rotary article transfer device. The article transfer mechanism engages or picks up the article or carton at a first location, such as a magazine, transports the carton through a predetermined travel path and disengages or places the carton at a second location, such as a conveyor. The article transfer mechanism comprises a rectilinear support rod having a horizontally oriented central axis. The support rod is linked to an article transfer device and rotatable about the axis. The mechanism further has at least one first vacuum engagement member for engaging the carton at a predetermined location on one of a plurality of planar surfaces on the carton. The first vacuum engagement member has a rectilinear, hollow stem with an axial bore. A contact cup is disposed at the one end of the stem. The stem is connected to the support rod at a second end and extends therefrom so that the stem axis is perpendicular to the support rod axis. The article transfer mechanism further has at least one second vacuum engagement member for contacting the carton at a predetermined location on a second planar carton surface. The second vacuum engagement member also has a rectilinear hollow stem with an axial bore, and a contact cup disposed at one stem end. The opposite stem end is connected to the support rod via a connection bracket and extends therefrom so that the stem axis is also perpendicular to the support rod axis. Importantly, the second stem axis is further oriented so that it is non-parallel with the axis of the first vacuum engagement member.

The article transfer mechanism further has a vacuum control mechanism which provides a vacuum to the first and second vacuum engagement members. The vacuum control mechanism provides vacuum to the first and second vacuum engagement members for first and second predetermined time periods, respectively. Additionally, the article transfer mechanism has at least one stabilizing member which contacts the article at a predetermined location on a third planar carton surface and places an extensive force thereon. The stabilizing member has an elongated predetermined configuration and is connected to the first vacuum engagement member stem via a connection bracket.

These and other benefits of this invention will become clear from the following description by reference to the drawings.

DESCRIPTION OF THE PREFERRED EMBODIMENT

Figure 1:
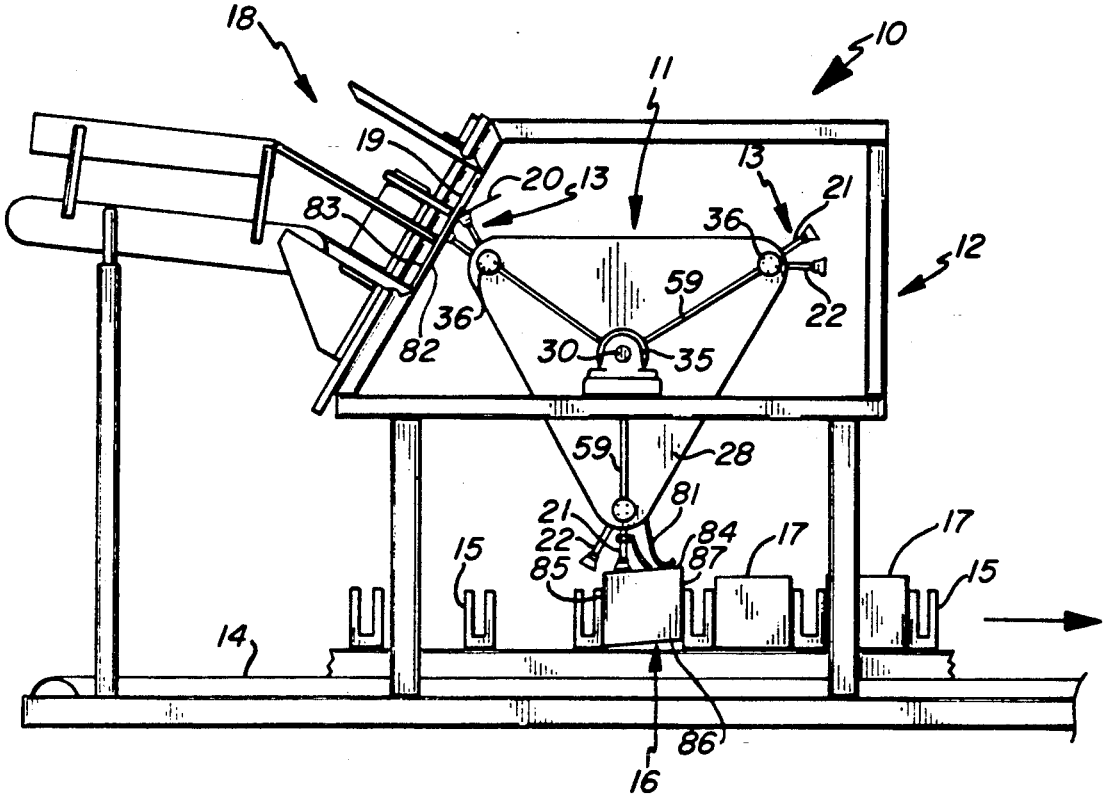
FIG. 1 is a side plan view of a rotary article transfer device with the article control assembly of the present invention.

Referring to FIG. 1, a rotary carton erecting device 10 is shown for the pickup, transfer and placement of articles. Rotary carton erecting devices of this structure are known in the art. For example, Applicant's assignee manufactures rotary transfer devices as disclosed in U.S. Pat. Nos. 4,530,686, 4,643,633 and 4,802,324. These rotary transfer devices utilize frame structures upon which article pickup and deposit mechanisms travel in predetermined paths. The rotary transfer devices include a stationary gear, at least one planetary gear and structure for rotating the planetary gear about the stationary gear. An article transfer mechanism is in communication with each planetary gear for the pickup and delivery of articles, such as cartons.

It is in within the purview of this invention to use the article control assembly with article transfer devices such as the rotary devices of the above referenced patents which are hereby incorporated by reference. Additionally, the article control assembly can be utilized with other prior art article transfer devices, such as rotary transfer devices which utilize chains to drive the article transfer mechanisms and those which utilize stationary pin arrangements to drive the article transfer mechanisms, for example.

The article control assembly of this invention is particularly useful to aid the rotary carton erecting device 10 and the article transfer mechanism 13 of its associated article transfer device 11 in the transfer of cartons onto conveyors which are then merged with moving product groups, such as groups of bottles. For example, the article control assembly aids in increasing the speed of pickup, transfer and placement of cartons 19 from a storage magazine or hopper 18 to thereby increase the speed of the packaging operation. Increases in the rate of transfer of approximately 100 percent have been obtained utilizing the teachings of this invention. For example, a transfer rate of approximately 150 cartons per minute utilizing a standard article transfer mechanism has been increased to approximately 360 cartons per minute utilizing the article control assembly.

Figure 10:
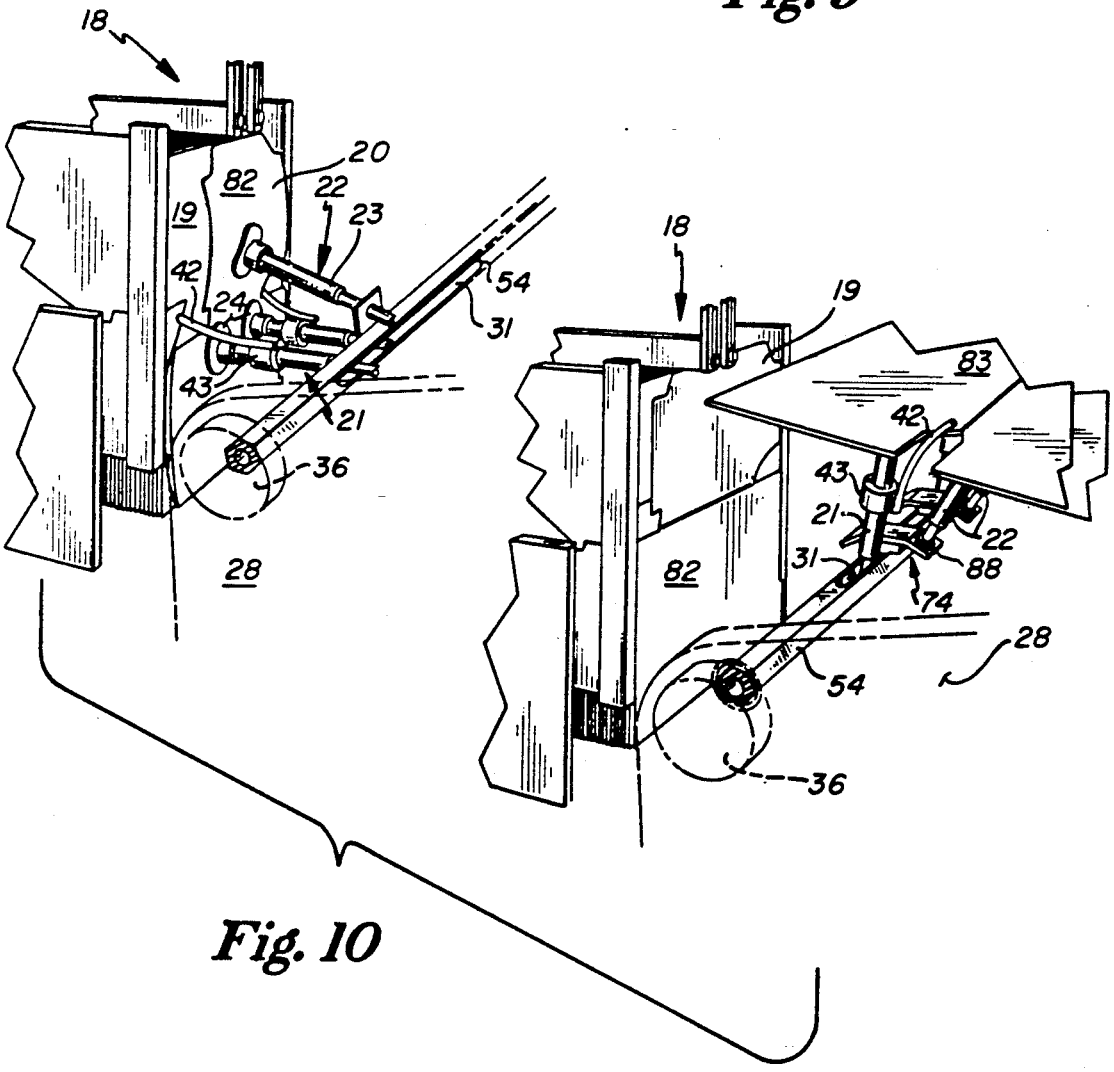
FIG. 10 show a perspective views of the article control assembly in conjunction with an article transfer mechanism performing pickup and transfer functions with respect to a carton blank.

As will be further discussed, the assembly preferably has a structural configuration to engage cartons at a plurality of predetermined locations at predetermined time intervals in their travel path. The article control assembly as shown, is particularly useful in the high speed transfer of relatively tall and narrow cartons with a plurality of separate planar portions. Referring to FIG. 1, in their initial flat configuration (carton blank), the cartons 19 have a facing wall 82 which is exposed in the magazine 18 for contact by elements of the article transfer device 11. A parallel and substantially coextensive back wall 83 is coupled to the top and bottom ends of the facing wall 82 via fold lines. Each wall further has a generally centrally disposed fold line which divides it into two planar panels upon erection (see carton 16). As shown, the top portion of the facing wall 82 becomes the trailing side panel 85 of the erected, conveyed carton 16 or 17, while the bottom portion of the facing wall 82 becomes the top panel 84 of the conveyed carton. The top portion of the back wall 83 becomes the bottom panel 86 of the erected carton and the bottom portion becomes the leading side panel 87. Additionally, each wall 82 and 83 is shown to have laterally extending tabs. The tabs are folded inwardly subsequent to placement to form the end panels of the erected cartons. As shown in FIG. 10, a slot is formed between the trailing panel 85 tabs and the top panel 84 tabs which exposes a small area of the interior face of the back wall 83 leading panel 87. Also as will be discussed, the article control assembly additionally and preferably has a structural configuration to contact and exert a predetermined force at a predetermined location or locations of the carton to slightly space apart the facing and back walls 82 and 83 of the carton during transfer so that an air space is provided between the interior surfaces of the flat carton blanks to, thereby, increase their structural stability at high transfer speeds.

Figure 2:
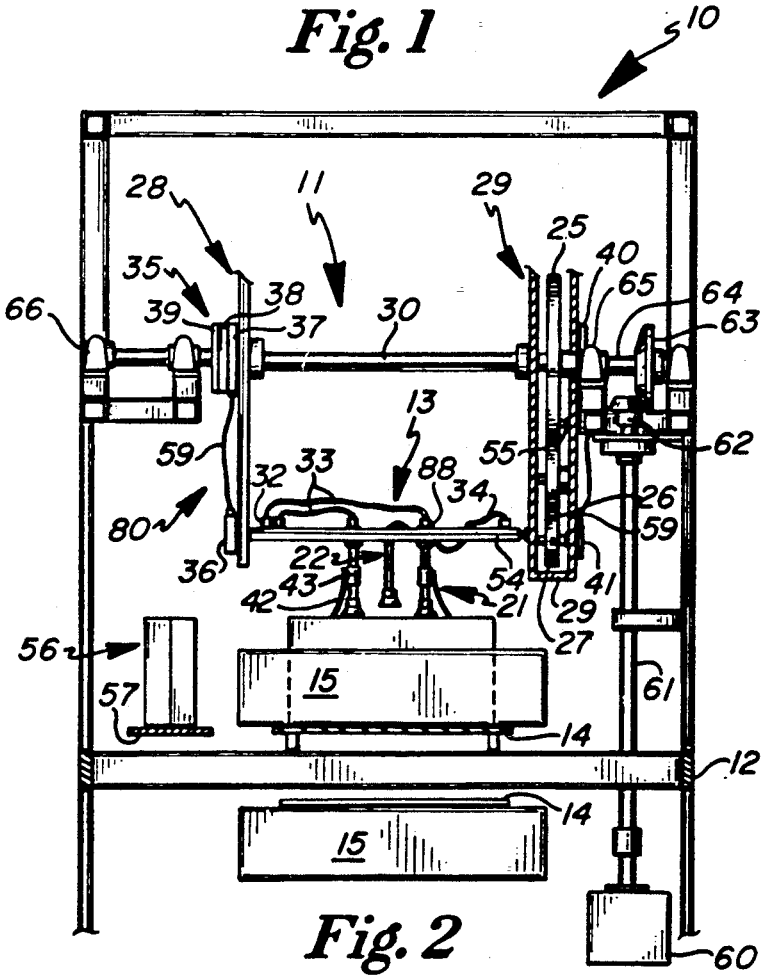
FIG. 2 is an end plan view of the article transfer device with a single article transfer mechanism incorporating the article control assembly.

As shown in FIG. 1, the rotary carton erecting device 10 has a frame structure 12 and an article transfer device 11 which has a number of article transfer mechanisms 13. The article transfer device 11 rotates in a continuous manner whereby the article transfer mechanisms 13 reach apex positions of travel at predetermined locations. Although, the device 11 as shown has three (3) apex positions, devices having alternate configurations, such as four (4) apex positions, are useable with the article control assembly of this invention. At an approximate 10 o'clock apex location, an article transfer mechanism 13 engages the article storage means 18 to remove a single carton 20. Each article transfer mechanism 13 rotates with respect to the rotation of the article transfer device 11 and reaches an approximate 6 o'clock apex position at its bottom to place the carton 16 or other article into an opened position for subsequent packaging to form groups of individual products, such as bottles. The cartons 17 are continuously moved adjacent and below the article transfer device 11 on a line conveyor 14 having spaced flights 15, which aid in carton erection. The carton structures 17 are placed onto the line conveyor 14 in proximity to an instream flow of individual products 56 on a separate conveyor 57, as shown in FIG. 2. Thereafter, and as known in the art, the carton structures 17 form configurations whereby the product groupings, for example, four (4) packs of product containers 57, are subsequently inserted into the aligned carton configuration. Thereafter, and as also known in the art, the carton configuration is closed, for example, via tab insertion or gluing, to form a completed package, for example, a completed four (4) pack of product.

FIG. 2 illustrates the article transfer device 11 having one of the article transfer mechanisms 13 for clarity. As is disclosed in U.S. Pat. No. '686, rotary carton erecting devices may have any number of article transfer mechanisms 13, for example, 1, 2, 3, or 4 mechanisms depending upon the types of articles being transferred, the size and shape of those products, and the desired speed of article transfer. However, the utilization of the article control assembly structure of this invention with an article transfer mechanism 13 is the same for any such article transfer device.

The article transfer device 11 has a center shaft 30 mounted for rotation in journals 65 and 66 which are supported by the frame structure 12. Side plates 28, 29 are provided for supporting the remaining elements of the article transfer device 11 and which rotate with the center shaft 30. The movement of the article transfer device 11 is provided by a power source 60, a drive shaft 61, and bevel gears 62 and 63. The shaft portion 64 of center shaft 30 extends from the beveled gear 63 to provide rotation for the center shaft 30.

As is known, the center gear 25 is stationary and is connected to the frame 12 by means of a connecting structure 55. A side plate 29 is shown connected to the idler gear 26 and the planetary gear 27.

Extending for rotation with the planetary gear 27 is the vacuum shaft 54. The shaft 54 is shown to have a hexagonal (six-sided) cross-sectional structure, although alternate configurations as known in the art are useable, for example, round or square configurations. In the preferred embodiment, the rod further has partial axial vacuum bores at each end. A pair of first or standard vacuum engagement members 21 extend from the shaft 54 perpendicular to its axis, for rotation therewith through predetermined travel paths. Each engagement member 21 comprises a hollow, elongated stem 23 which has an elastomeric cup or head 24 disposed at one end. At its opposite end, the stems 23 are connected to the rotatable vacuum shaft 54 through an elongated channel 31 (see FIGS. 10 and 11) in the shaft 54.

Figure 3:
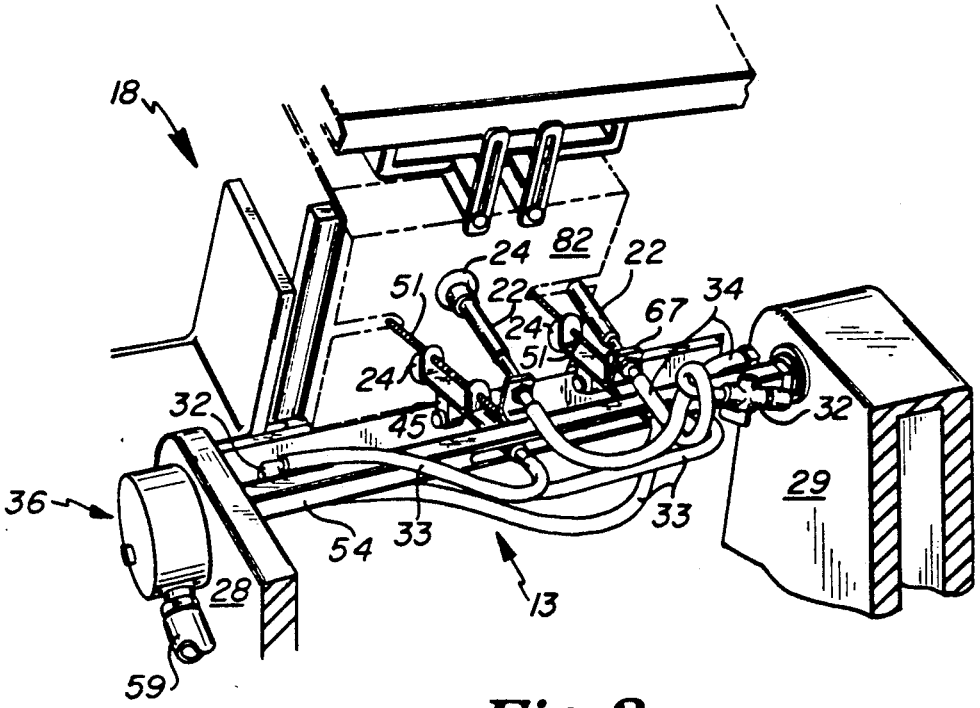
FIG. 3 is a detailed perspective view of the article transfer mechanism with an alternate embodiment of the article control assembly.

Referring also to FIG. 3, the length of extension of each stem 23 from the shaft 54 is adjustable via a pair of adjustment nuts 88. Additionally, the lateral position of each first engagement member 21 is adjustable along the length of the shaft channel 31. The two engagement members 21 are arranged spacially parallel to one another and are coplanar. The particular length of extension and spacing distance is dependent upon the characteristics of the carton blank or other article which is to be transferred. Two engagement members 21 are shown arranged for transferring a particular carton used to package four containers. The first engagement members 21 contact predetermined locations side-by-side on the top panel 84 of the facing wall 82, just below the fold line separating the two panels 84 and 85 thereof. However, additional first or standard engagement members are useable depending upon container configuration and size, for example, a third first engagement member may be used for a six-pack container having a wider configuration. Similarly, a single engagement member could be used for smaller cartons. The above described structural elements generally comprise an article transfer mechanism as known in the art.

A single second vacuum engagement member or control member 22 is also shown extending perpendicularly from the vacuum shaft 54 for rotation therewith through a predetermined travel path. The second engagement member 22 also has a rigid stem 23 with an elastomeric cup 24 at its extended end an additional, inoperative second vacuum engagement member 22 is shown without a cup 24. In the preferred embodiment, the stem 23 is connected at its opposite end to the vacuum shaft 54 via a mounting bracket 67 so that it is non-parallel with the first engagement members 21 and further forms an angle with respect to the first engagement members 21 of approximately 20 degrees. Importantly, the second vacuum engagement member 22 is non-coplanar with the plane of extension defined by the pair of first vacuum engaqement members 21. The second engagement member 22 is aligned to contact a predetermined location on the carton facing wall 82 trailing panel 85, just above the fold line between the top and trailing panels 84 and 85 thereof. The contact or engaqement location is generally centrally spaced with respect to the two carton contact locations of the first engagement members 21. In its operative engagement with this particular carton area, the second engagement member 22 provides additional holding force and stability to the flat carton during high speed transfer. Additionally, due to its angled configuration with respect to the first engagement members 21, the second engagement member 22 contacts (and engages due to its synchronized vacuum control period described below) the carton wall 82 at an earlier point, independent of the travel path of the first engagement members 21. This approach angle increases the reliability of engagement at high speed during the pickup phase of the transfer process. Additionally, the angled configuration allows the second engagement member 22 to release the article at an earlier point in the placement phase of the transfer process, thus, increasing the effectiveness and smoothness of placement, particularly at high speeds. Although a single second engagement member 22 is shown for use in the four pack cartoning operation, additional such second or control engagement members are useable depending upon carton configuration. The important consideration is that such second engagement members are non-coplanar with the first engagement member or members 21.

FIG. 3 show three standard engagement members 21 and two control engagement members 22. However, only two standard and one control engagement member are operative and shown to have cups 24. The remaining stems are in position to be activated for use with six-pack cartons.

Figure 6:
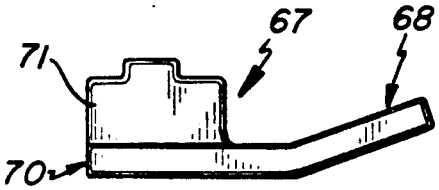
FIG. 6 is a side view of another embodiment of a connection bracket for the stabilizing member.
Figure 7:
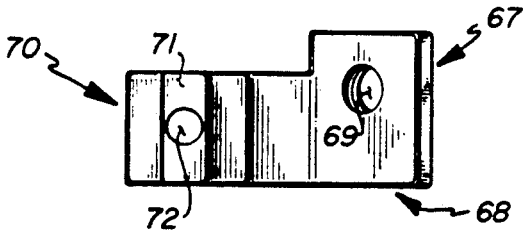
FIG. 7 is a top view of the bracket shown in FIG. 6.

Referring also to FIGS. 6 and 7 the mounting bracket 67 is shown to have a rigid angled configuration with first and second portions 68 and 70. The second portion 70 has a raised mounting ridge 71 which is mateable with the vacuum rod 54 channel 31. The mounting ridge 71 has a threaded aperture 72 for extension therethrough of a bolt for securement to the vacuum rod 54. The first portion 68 extends from the second portion 70 at an angle of approximately 20 degrees. The first portion 68 has an aperture 69 for extension of the second engagement member 22 stem 23 end therethrough. The stem 23 is secured in this position via a securement nut disposed on each side of the first portion 68, and which also allow for adjustment of the extension length of the second engagement member 22. This structural configuration provides the proper spacial orientation between the first and second engagement members 21 and 22 as previously discussed. The angle between the first and second portions 68 and 70 of the mounting bracket 67 may be varied depending upon the particular carton configuration, contact locations thereon, and the type of vacuum rod used.

Figure 8:
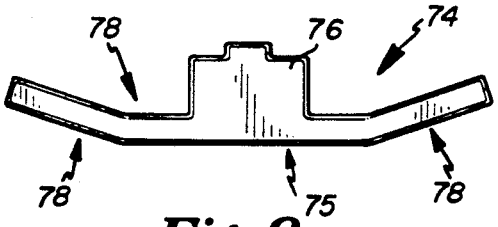
FIG. 8 and is a side view of another embodiment of the connection bracket.
Figure 9:
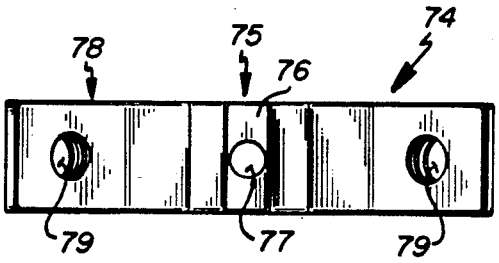
FIG. 9 is a top view of the bracket shown in FIG. 8.

Referring also the FIGS. 8, 9 and 10, an alternate embodiment of the mounting bracket 74 is shown. The bracket 74 has a center portion 75, with two angled side portions 78. A raised slotted mounting portion 76 includes an aperture 77 for coupling with the vacuum rod 54. Apertures 79 are located in each side portion 78 for mounting of a second engagement member 22 at either end.

Referring again to FIG. 2, the article transfer mechanism 13 is shown to have a pair of stationary article stabilizing members consisting of rigid elongated extension members 42 which are coupled to the stems 23 of the first engagement members 21, via couplings 43. Each extension member 42 has a thin circular cross-sectional configuration which is oriented along side its respective first engagement member 21, extending beyond the respective vacuum cups 24 a predetermined distance and curving laterally away therefrom, and further has a rounded tip or end. During the pickup phase of operation, the ends of the extension members 42 are positioned through the slots formed in the carton blank facing wall 82, and contact the back wall interior side exposed thereby (see also FIG. 10). The extensive force exerted by the extension members 42 on the back wall interior separates the back wall 83 from facing wall 82 a slight distance, creating an air space or gap therebetween. The air gap allows air to go into the walls 82 and 83, which prevents back breaking of the cartons. The back breaking phenomenon is caused by the failure of the closely spaced walls 82 and 83 to separate during the placement phase of the transfer operation due to the creation of a vacuum or suction between the facing and back walls 82 and 83 during high speed travel. The extension distance between the end of the extension member 42 and the engagement member cup 24 is proportional to the degree of wall separation.

Figure 4:
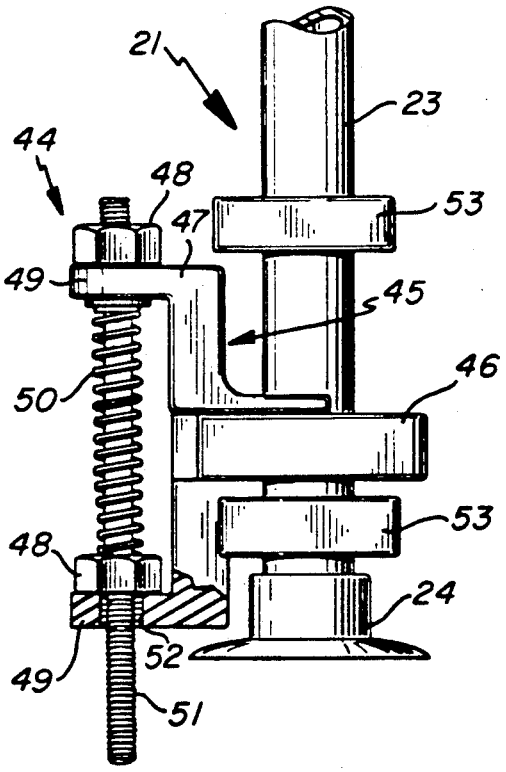
FIG. 4 is a front plan view of a stabilizing member in operative connection with a vacuum engagement member.
Figure 5:
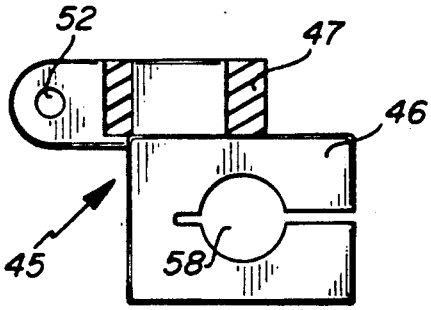
FIG. 5 is a top view of the stabilizing member connection bracket shown in FIG. 4.

FIGS. 3-5 show an alternate embodiment of the article stabilizing members 44 generally comprising an elonqated probe 51, a connection bracket 45 and a biasing spring 50. The mounting bracket 45 has a stem connection portion 46 with a central aperture 58, through which is extended the stem 23 of a first engagement member 21. A lateral portion 47 is offset to the side of the connection portion 46 and has top and bottom arms 49. The probe 51 is disposed through aligned apertures 52 in the arms 49 and axially through the spring 50 which is disposed between the arms 49. Nuts 48 are provided to secure the probe 50. The spring biased stabilizing member embodiment 44 provides a variable force upon the contact areas of the carton proportional to the particular point in the travel path of the stabilizing member 44. Shaft collars 53 are shown connected to the stem 23.

The stabilizing members 42 and 44 further cooperate with the second or control engagement members 22, and the first or standard engagement members 21 to improve the reliability of the article placement phase of the transfer process by exerting their extensive forces in synchronization with the release of vacuum actuated attractive forces by the respective engagement members 22 and 21. This cooperation assists in placing the cartons in the proper erected position between the flight 15 of the conveyor 14. An elongated, curved placement assist structure is shown to further assist in article placement.

Referring to FIGS. 2 and 3, the vacuum control system of the apparatus 10 is generally referred to as 80. The vacuum control system 80 is directly operative on the article transfer mechanism 13 to provide timed and synchronized vacuum to the first and second engagement members 21 and 22. The vacuum control system generally comprises two center valves 35 and 40 which independently provide vacuum to the first and second engagement members 21 and 22, respectively. Each center valve 35 and 40 is linked to a planetary valve 36 and 41, respectively, via a flexible conduit 59. The planetary valves 36 and 41 are communicatively connected to separate axial vacuum bores in the respective ends of the support rod 54. The planetary valves 36 and 41 allow the support rod 54 to rotate while maintaining continuous connection. The vacuum bores in the support rod are connected to hose junctions 32 which mate with respective connection hoses or tabs 33 and 34. The hoses 33 and 34 are coupled to the respective ends of the hollow stems 23 of the vacuum engagement members 21 and 22.

As shown, the center valves 35 and 40 each consist of a rotationally communicating pair of internally ported and slotted nylon discs 37 and 38 which are located axially at center shaft 30. This vacuum control arrangement is generally known in the art, and it generally functions as one disc 37 rotates along with the center shaft 30, while the communicating disc 38 remains stationary. The stationary disc 38 is secured in place via a connection plate 55. The stationary disc 38 has one or more slots which are communicatively connected to a vacuum pump or other vacuum source (not shown). The rotating disc 37 has one or more ports of a predetermined configuration which are connected to the connecting hose 59. Thus, as drive shaft 30 and rotary plates 28 and 29 are driven by power means 60, the predetermined ports and slots within the pair of center valves 35 and 4 communicate when aligned through the travel path of the rotating disc 37 so as to provide periods of vacuum source and vacuum release operative on the respective first and second engagement members 21 and 22.

The slot and port configurations of the center valves 35 and 40 are selected to yield predetermined periods of vacuum source and release to the respective first and second engagement members 21 and 22. And, because both valves 35 and 40 are linked to and rotate with the common center shaft 30, the vacuum source and release periods of the engagement members 21 and 22 are synchronized. The first or standard center valve 35 provides timed vacuum source and release periods to the first engagement members 21. Referring particularly to FIG. 1, its vacuum source period begins approximately at the 10 o'clock apex position of the first engagement member 21 travel path, where the first engagement members are perpendicularly oriented with a carton blank 20 facing wall 82, and extends through the 6 o'clock apex position. The second or control center valve 40 provides timed vacuum source and release periods to the second engagement member 22. Its vacuum source and release periods are synchronized to lead the vacuum source and release periods of the first engagement members 21, and further correspond to a generally perpendicular relationship with the engaged carton wall 82. Thus, the second engagement member 22 engages the carton 20 facing wall 82 earlier to enable high speed pickup, and disengages the trailing panel 85 of the facing wall 82 earlier to enable high speed placement.

As many changes are possible to the embodiments of this invention utilizing the teachings thereof, the descriptions above, and the accompanying drawings should be interpreted in the illustrative and not the limited sense.

That which is claimed is:

1. An article transfer mechanism of an article transfer device for transferring articles to a predetermined location via a travel path, comprising:

a) a support structure having a central axis;

b) engagement means extending outwardly from said support structure generally perpendicular to said support structure axis, said engagement means contacting the article at a first predetermined location thereon;

c) synchronized vacuum means operative on said engagement means for a predetermined time period; and d) article control means contacting the article at a second predetermined location and applying a force thereto, said article control means comprising second engagement means extending outwardly from said support structure perpendicular to said support structure axis, and being non-parallel to said first engagement means, said second engagement means further having means to provide a vacuum to apply an attractive force to said second predetermined location of the article for a second predetermined time period.

2. The article transfer mechanism of claim 1, wherein said article control means further comprises at least one extension member having a predetermined configuration and being coupled with said support structure, said extension member being constructed and arranged to apply an extensive force to the article.

3. The article transfer mechanism of claim 2, wherein said extension member comprises a rigid, stationary probe having an elongated configuration, and a connection bracket coupled to said engagement means, said extension member stabilizing the article during high speed transfer.

4. The article transfer mechanism of claim 2, wherein said extension member comprises an elongated probe, means to bias said probe, and a connection bracket coupling said elongated probe and said biasing means to said engagement means, said extension member stabilizing the article during high speed transfer.

5. The article transfer mechanism of claim 1, wherein said first and said second engagement means each comprise at least one vacuum engagement member being connected to said support structure and extending therefrom, and wherein said first engagement means and said second engagement means have separate and distinct timed vacuum intervals.

6. The article transfer mechanism of claim 5, wherein said first engagement means comprises two spacially parallel and aligned vacuum engagement members, and wherein said second engagement means comprises one vacuum engagement member.

7. The article transfer mechanism of claim 5, wherein said first engagement means comprises three spacially parallel and aligned vacuum engagement members, and wherein said second engagement means comprises two spacially parallel and aligned vacuum engagement members.

8. The article transfer mechanism of claim 6, wherein said mechanism is constructed and arranged to transfer carton blanks in an initially flat configuration from a magazine to an erected configuration on a conveyor, the carton blanks having first and second parallel walls which are coupled at their ends via fold lines, each wall member further having a generally centrally disposed fold line, thereby defining two planar panels in each wall, and wherein said first vacuum engagement members are positioned to engage one planar panel of the first wall, and said second vacuum engagement member are positioned to engage the other panel of the first wall.

9. The article transfer mechanism of claim 6, wherein said spacially parallel first vacuum engagement members are further spacially oriented so as to define a plane, and wherein said second vacuum engagement member is non-coplanar with said first vacuum engagement members.

10. The article transfer mechanism of claim 6, wherein each said vacuum engagement member comprises an elongated, rigid stem with a hollow axial bore and first and second ends, and an elastomeric contact cup disposed at said first end, each said stem being coupled to said support structure at said second end.

11. The article transfer mechanism of claim 10, further comprising means to mount said second vacuum engagement member stem to said support structure, whereby said second stem axis is extended from said support structure at an angle with respect to said first vacuum engagement member stem axis.

12. The article transfer mechanism of claim 11, wherein said mounting means comprises a bracket having a first planar portion with an apertured fastening structure, said first portion being mountable on said support structure, and a second planar portion extending from said first portion at a predetermined angle therefrom, said second portion having an aperture for coupling said second vacuum engagement member stem at its second end.

13. The article transfer mechanism of claim 6, Wherein said support structure is a substantially solid rod having a non-circular cross-sectional configuration of at least four sides and further having a generally centrally disposed elongated aperture for adjustably mounting said first vacuum engagement members thereto, and wherein said vacuum engagement members each comprise a rectilinear stem with a hollow axial bore and first and second ends, and a contact cup disposed at said first end, said first vacuum engagement member stems being coupled to said support structure elongated aperture at said second ends, and said second vacuum engagement members each being coupled to said support structure via a bracket having a first planar portion with an aperture therethrough, said first portion being mountable to said support structure by a fastener through said support rod aperture, and a second planar portion connected to said first portion at a predetermined angle therefrom, said second portion further having an aperture for coupling said second vacuum engagement member stem at its second end.

14. The article transfer mechanism of claim 1, wherein said means to provide a vacuum comprises a vacuum pump, a vacuum control mechanism, and a vacuum source conduit.

15. The article transfer mechanism of claim 14, wherein said vacuum control mechanism comprises at least one valve which comprises a stationary disc member having at least one slot disposed at a predetermined location, said valve further comprising a rotating disc member which is substantially coextensive with said stationary disc member and having at least one port disposed at a predetermined location, said slot further being communicatively connected to said vacuum pump, and said port being communicatively connected to said vacuum source conduit, whereby said port is communicatively aligned with said slot for a predetermined period of time during rotation of said rotating disc member.

16. The article transfer mechanism of claim 15, wherein said vacuum control mechanism comprises two valves, a first valve providing timed vacuum to said first engagement means for a first predetermined time period, and a second valve providing timed vacuum to said second engagement means for a second predetermined time period.

17. The article transfer mechanism of claim 16, wherein said vacuum source conduit comprises at least one hose interconnecting each said valve with its respective contact means.

18. The article transfer mechanism of claim 14, wherein said vacuum source conduit includes axial bores in said support structure and said first and second engagement means interconnected by said respective hoses.

19. The article transfer mechanism of claim 1, wherein the article transfer device is a rotary transfer device, and wherein said support structure comprises a rotatable rectilinear rod structure which is connected at at least one end to the rotary transfer device.

20. The article transfer mechanism of claim 19, wherein said support structure rod is hollow and has a pair of axial vacuum bores to provide a vacuum.

21. The article transfer mechanism of claim 19, wherein said support structure rod is substantially solid and has a non-circular cross-sectional configuration of at least four sides, and further has a generally centrally disposed elongated aperture for mounting said engagement means.

22. The article transfer mechanism of claim 21, wherein said support structure rod has a hexagonal cross-sectional configuration.

23. An article transfer mechanism of an article transfer device, comprising:

a) a rotatable support structure having a central axis;

b) first engagement means extending from said support structure perpendicular to said support structure axis, said first engagement means being for grasping the article at a first predetermined location thereon, said first engagement means having a travel path defined by the rotation of said support structure;

c) second engagement means extending from said support structure perpendicular to said support structure axis and being non-parallel to said first engagement means, said second engagement means being for grasping the article at a second predetermined location and applying an attractive force to said second predetermined location on the article, said second engagement means having a travel path defined by the rotation of said support structure; and d) means to provide a vacuum to said first and to said second engagement means, said vacuum means providing vacuum to said first engagement means during a predetermined period of its travel path, and further providing vacuum to said second engagement means for a predetermined period of its travel path.

24. An article transfer mechanism of an article transfer device for transferring carton blanks in an initially flat configuration from a predetermined location to an erected configuration on a conveyor, the flat carton blanks being of the type having a facing wall and a parallel, substantially coextensive and closely spaced back wall which is coupled at its ends to facing wall ends via spacially parallel fold lines, each wall further having a fold line disposed approximately at its midpoint, the facing wall further having at least one slot exposing a portion of the back wall, comprising:

a) a rotatable support structure having a central axis;

b) engagement means extending from said support structure perpendicular to said support structure axis, said engagement means being for grasping the carton on its facing wall, said engagement means having a travel path defined by the rotation of said support structure;

c) means to provide a vacuum to said engagement means during a predetermined period of said travel path; and d) at least one stabilizing member having a predetermined elongated configuration with an extended first end which is positioned with respect to said support structure so that it extends through the carton blank facing wall slot to contact the back wall, whereby it is slightly spaced apart from the facing wall, said stabilizing member further having a second end which is coupled to said engagement means via a connection bracket.

25. The article transfer mechanism of claim 24, wherein said stabilizing member comprises a rigid, stationary probe having an elongated configuration.

26. The article transfer mechanism of claim 24, wherein said stabilizing member comprises an elongated probe and means to bias said probe.

27. A high speed article transfer mechanism for engaging carton blanks at a first location, transporting and disengaging erected cartons on a synchronized conveyor, and for use with a rotary carton erecting device, the cartons having a plurality of planar surfaces, comprising:

a) a rotatable support rod having a horizontally oriented central axis, said support rod being rotatable about said axis;

b) at least one first vacuum engagement member for grasping a predetermined location on a first carton surface, said first vacuum engagement member having a rectilinear, hollow stem with an axial bore, first and second ends, and a contact cup disposed at said first end, said stem being connected to said support rod at said second end and extending therefrom so that the stem axis is perpendicular to said support rod axis, said first vacuum engagement member having a predetermined travel path;

c) at least one second vacuum engagement member for grasping a predetermined location on a second carton surface, said second vacuum engagement member having a rectilinear hollow stem with an axial bore, first and second ends, and a contact cup disposed at said first stem end, said stem being connected to said support rod at said second end and extending therefrom so that said stem axis is perpendicular to said said support rod axis, said second stem axis being non-parallel with said first stem axis, said second vacuum engagement member having a predetermined travel path;

d) means to provide a vacuum to said first and to said second vacuum engagement members, said vacuum means providing vacuum to said first vacuum engagement member during a predetermined period of its travel path, and providing vacuum to said second vacuum engagement member during a predetermined period of its travel path; and e) means to stabilize the carton blank, said means to stabilize being disposed to rotate with said support rod and contacting a predetermined location on a third carton surface.

* * * * *